US007286785B2

(12) United States Patent
Hashimoto et al.

(10) Patent No.: US 7,286,785 B2
(45) Date of Patent: Oct. 23, 2007

(54) IMAGE FORMING APPARATUS

(75) Inventors: Shunichi Hashimoto, Kanagawa (JP); Shin Kayahara, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 1 day.

(21) Appl. No.: 11/289,267

(22) Filed: Nov. 30, 2005

(65) Prior Publication Data

US 2006/0140665 A1 Jun. 29, 2006

(30) Foreign Application Priority Data

Dec. 27, 2004 (JP) ..... 2004-376747
Dec. 27, 2004 (JP) ..... 2004-376748

(51) Int. Cl.
*G03G 15/16* (2006.01)
*G03G 15/00* (2006.01)

(52) U.S. Cl. ..... 399/101; 399/66; 399/71

(58) Field of Classification Search ..... 399/101, 399/71, 66

See application file for complete search history.

(56) References Cited

U.S. PATENT DOCUMENTS

| | | | |
|---|---|---|---|
| 6,061,543 | A | 5/2000 | Kayahara et al. |
| 6,212,351 | B1 | 4/2001 | Kawagoe et al. |
| 6,269,228 | B1 | 7/2001 | Kayahara et al. |
| 6,505,024 | B2 | 1/2003 | Kayahara et al. |
| 6,560,438 | B2 | 5/2003 | Kosuge |
| 6,654,574 | B2 | 11/2003 | Kayahara et al. |
| 6,697,595 | B2 | 2/2004 | Kawagoe et al. |
| 6,701,118 | B2 | 3/2004 | Kayahara et al. |
| 6,778,794 | B2 | 8/2004 | Kayahara |
| 6,901,234 | B2 | 5/2005 | Ogiyama et al. |
| 2003/0215269 | A1 | 11/2003 | Kayahara et al. |
| 2004/0136760 | A1 | 7/2004 | Yoshida et al. |
| 2005/0013636 | A1 | 1/2005 | Sawai et al. |
| 2005/0105927 | A1 | 5/2005 | Kayahara |

FOREIGN PATENT DOCUMENTS

| | | | |
|---|---|---|---|
| JP | 10-312143 | | 11/1998 |
| JP | 2000-19921 | | 1/2000 |
| JP | 2003-39819 | | 2/2000 |
| JP | 2000039819 | A * | 2/2000 |
| JP | 2001-134109 | | 5/2001 |
| JP | 2001134109 | A * | 5/2001 |
| JP | 2003-5608 | | 1/2003 |

OTHER PUBLICATIONS

Oki Technical Review.*
Oki Electric Industry Co., Ltd., "Oki Technical Reviiew", Copyright 1998, .oki.com/en/otr/html/nf/otr-161-05-tab-1.html.*

* cited by examiner

*Primary Examiner*—David M. Gray
*Assistant Examiner*—Joseph S. Wong
(74) *Attorney, Agent, or Firm*—Oblon, Spivak, McClelland, Maier & Neustadt, P.C.

(57) ABSTRACT

A tandem image forming unit is provided with an adhering substance removal mode for performing a cleaning operation of a photoreceptor and an intermediate transfer body at the time other than the time of image formation. In the adhering substance removal mode, a photoreceptor cleaning unit removes excess toner from the photoreceptor. An intermediate transfer body cleaning unit removes excess toner from the intermediate transfer body. Therefore, the adhering substance removal mode can be performed simultaneously with respect to the photoreceptor and the intermediate transfer body.

12 Claims, 6 Drawing Sheets

IMAGE FORMING APPARATUS

CROSS-REFERENCE TO RELATED APPLICATIONS

The present document incorporates by reference the entire contents of Japanese priority documents, 2004-376748 filed in Japan on Dec. 27, 2004 and 2004-376747 filed in Japan on Dec. 27, 2004.

BACKGROUND OF THE INVENTION

1. Field of the Invention

The present invention relates generally to an image forming apparatus utilizing electro-photographic technology such as a copier, printer, and facsimile, and, more particularly, to technology for removing adhering substances in the image forming apparatus.

2. Description of the Related Art

Intermediate transfer is widely employed in image forming apparatuses. This technique includes a primary transfer that includes transferring a toner image formed on an image carrier to an intermediate transfer body, and a secondary transfer that includes transferring the toner image on the intermediate transfer body to a transfer material. To allow the primary transfer, the image carrier and the intermediate transfer body are in physical contact with each other. Moreover, generally, the image carrier and the intermediate transfer body can also directly or indirectly contact with other members. These members can be a transfer material, e.g., paper, and a rubber member, e.g., rollers and the like.

Various types of paper and various types of fiber portion of an ingredient and wide variety of additives to be added are used in image forming apparatuses. In image forming apparatuses, paper powders are produced due to friction of the paper with rubber rollers and the like when the paper is carried inside the apparatus. The paper powder is a common cause of failure of the image forming apparatuses. Especially, it is known that talc contained in the paper adheres to surfaces of the image carrier and the intermediate transfer body and cause a change in surface nature and surface resistance conditions of these members. This results in a distorted image. Moreover, an ingredient of the rubber of the rubber rollers may exude and contaminate the surfaces of the image carrier and the intermediate transfer body, resulting in distortion of images or deterioration of the surface natures.

Japanese Patent Application Laid-Open Publication No. 1998-312143 discloses an image forming apparatus that sequentially transfers images formed on an image carrier, such as a photoreceptor, onto a paper. This image forming apparatus includes a surface-stain detection unit that detectes, after development but before cleaning, surface stains on the image carrier, and a control unit that periodically operates the surface-stain detection unit, and, when an output value of the surface-stain detection unit falls below a predetermined value, that provides a control to form a toner image on an entire width of an image forming portion of an image carrier. Therefore, the surface stains are periodically detected by the surface stain detection unit, and when the output value becomes a predetermined value or less, a toner image is formed on the image carrier and fine powders aggregated on the image carrier can be removed along with toner of the toner image at the time of cleaning.

Various techniques have been used to solve the above problems. In a first technique, a rubber blade is used to clean the surfaces of the image carrier and the intermediate transfer body. When a rubber blade used, adhering substances can be cleaned more effectively by increasing an abutting pressure of the rubber blade to the image carrier and the intermediate transfer body. However, the rubber blade can chip-off, or scratch, the surfaces of the image carrier and the intermediate transfer body, which can result into streaky abnormal images. Moreover, the rubber blade itself is eaten-up is when the abutting pressure is increased.

In a second technique, a brush member and the like is used to clean the surfaces of the image carrier and the intermediate transfer body. However, the space and cost for additionally providing the brush member is problematic. Moreover, a means to collect adhering substances from the brush member itself becomes necessary. This leads to increase in size, complicatedness, and cost of the image forming apparatus.

SUMMARY OF THE INVENTION

It is an object of the present invention to at least solve the problems in the conventional technology.

According to an aspect of the present invention, an image forming apparatus includes an image forming unit configured to form a toner image on an image carrier; a transferring unit configured to transfer the toner image onto a transfer body by means of a transfer electric field; an image carrier cleaning unit configured to clean excess toner from the image carrier; and a transfer body cleaning unit configured to clean excess toner from the transfer body. At a time other than a time of image formation, a larger amount of toner is adhered to any one of the image carrier and the transfer body as compared to at the time of image formation, and an adhering substance removal operation is performed on any one of the image carrier and the transfer body by use of any one of the image carrier cleaning unit and the transfer body cleaning unit.

According to an aspect of the present invention, an image forming apparatus includes image forming means for forming a toner image on an image carrying means; transferring means for transferring the toner image onto a transfer body means by means of a transfer electric field; image carrier cleaning means for cleaning excess toner from the image carrying means; and transfer body cleaning means for cleaning excess toner from the transfer body means. At a time other than a time of image formation, a larger amount of toner, as compared to at the time of image formation, is adhered to any one of the image carrying means and the transfer body means, and an adhering substance removal operation is performed on any one of the image carrying means and the transfer body means by use of any one of the image carrier cleaning means and the transfer body cleaning means.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will now be described with reference to the accompanying drawings. In the description, although names of specific members are used to facilitate understanding of the present invention, it is clearly stated here that these names do not limit the applicable scope of the present invention.

Figure 1:
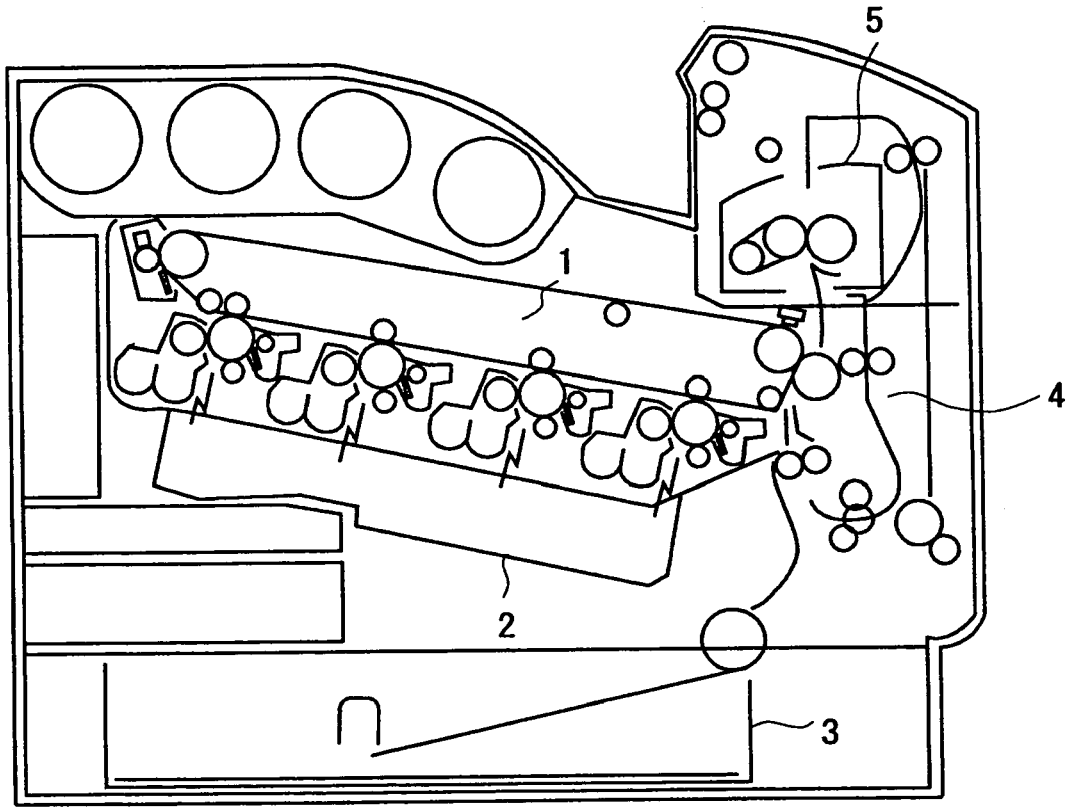
FIG. 1 is a schematic of a tandem-type image forming apparatus according to an embodiment of the present invention.

FIG. 1 is a schematic of an electro-photographic apparatus according to an embodiment of the present invention. Reference numeral 1 represents a tandem image forming unit; 2 represents a writing optical unit; 3 represents a paper feed table that supports the writing optical unit 2; 4 represents a carrying/reversal unit; and 5 represents a fixing unit that fixes an image onto a transfer material.

Figure 2:
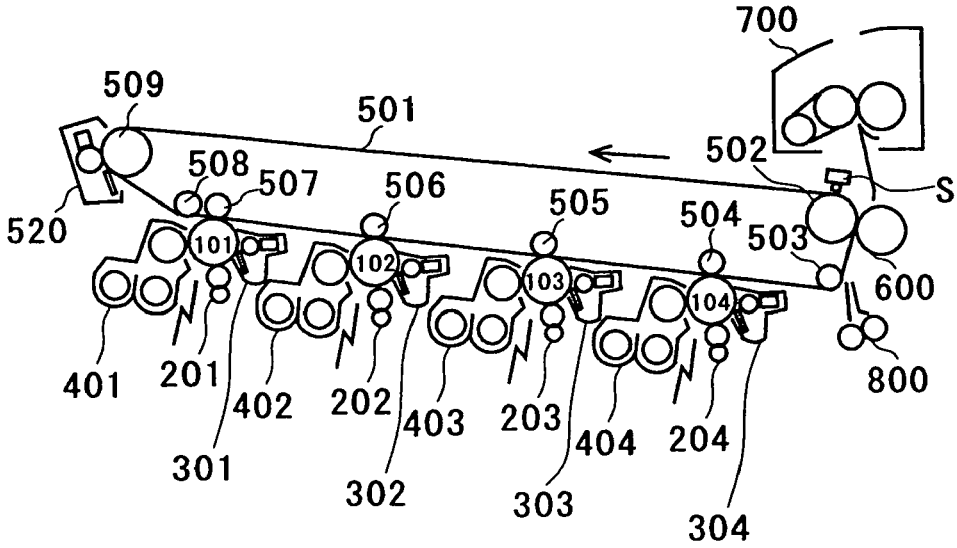
FIG. 2 is a schematic of an image forming section shown in FIG. 1.

FIG. 2 is an enlarged view of a configuration of a portion of the electro-photographic apparatus used to form an image. The tandem image forming unit 1 is provided with an intermediate transfer body 501 in a form of an endless belt in the center. The intermediate transfer body 501 includes a single-layer structure or a multilayer structure of rubber or resin.

The intermediate transfer body 501 is tightly stretched by a secondary transfer bias roller 502 and support rollers 503, 508, 509 and 510 and is rotatable in a counterclockwise direction. A secondary transfer unit 600 is provided oppositely to the secondary transfer bias roller 502 on the other side of the intermediate transfer body 501.

The secondary transfer bias roller 502 forms an electric field having the same polarity as toner with a secondary electric-field forming unit (not shown) and utilizes an electrostatic repulsive force thereof to secondarily transfer the toner to the transfer material. An intermediate transfer body cleaning unit 520 is located on the left of the support roller 509. The intermediate transfer body cleaning unit 520 removes residual toner staying on the intermediate transfer body 501 after transfer of an image.

Figure 3:
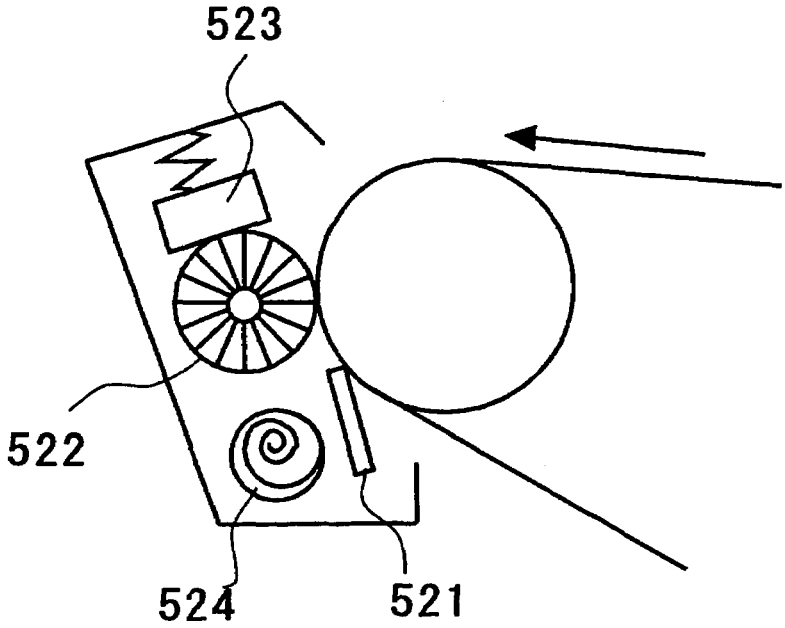
FIG. 3 is a schematic of an intermediate transfer body cleaning unit shown in FIG. 2.

FIG. 3 is an enlarged view of the intermediate transfer body cleaning unit 520. The intermediate transfer body cleaning unit 520 includes a blade member 521 that removes excess toner, a coil member 524 that carries the removed toner to a waste toner tank (not shown), a lubricant agent 523, and a lubricant agent application brush 522. An abutting angle, position, and pressure of the blade member 521 are suitably set depending on the type of the toner, an image forming rate and the like. The lubricant agent 523 is pressed against the lubricant agent application brush 522 by means of a spring or a spindle. The lubricant agent application brush 522 rotates and chips the lubricant agent 523 to apply the lubricant agent into the intermediate transfer body 501.

On the inside of the intermediate transfer body 501 between the support roller 503 and support roller 508, primary transfer bias rollers 504, 505, 506 and 507 are disposed which form an electric field at the time of the primary transfer and which can contact with the intermediate transfer body 501. The tandem image forming apparatus includes disposing four photoreceptors 101, 102, 103 and 104 which are lined up along the carrying direction on the other side of the intermediate transfer body 501, oppositely to the primary transfer bias rollers 504, 505, 506 and 507.

Around each photoreceptor 101 to 104 are provided corresponding photoreceptor charge units 201 to 204, photoreceptor cleaning units 301 to 304, and development units 401 to 404.

Figure 4:
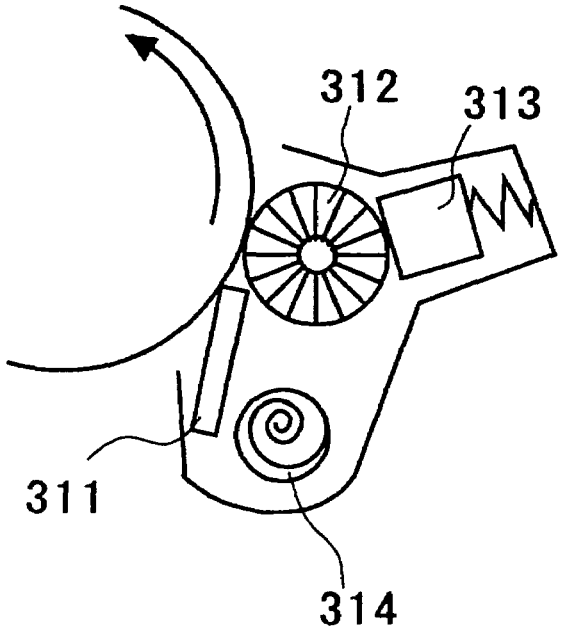
FIG. 4 is a schematic of a photoreceptor cleaning unit shown in FIG. 2.

FIG. 4 shows details of the photoreceptor cleaning units 301 to 304. Each photoreceptor cleaning units 301 to 304 includes a blade member 311 that removes excess toner, a coil member 314 that carries the removed toner to the waste toner tank, a lubricant agent 313, and a lubricant agent application brush 312. An abutting angle, position, and pressure of the blade member 311 are suitably set depending on the type of the toner, the image forming rate and the like. The lubricant agent 313 is pressed against the lubricant agent application brush 312 by means of a spring or a spindle. The lubricant agent application brush 312 rotates and chips the lubricant agent 313 to apply the lubricant agent into the corresponding photoreceptor 101 to 104.

The writing exposure to the photoreceptor is performed at a position between the photoreceptor charge units 201 to 204 and the development units 401 to 404 with laser irradiation by an exposure apparatus (not shown). Under the secondary transfer unit 600, a resist roller 800 is installed for sending a recording medium P to a secondary transfer portion, and over the secondary transfer unit 600, the fixing unit 5 is provided which fixes a toner image to the recording medium.

When the image forming operation is performed with the use of this color electro-photographic representation apparatus, first, an image signal is input from a personal computer or scanner (not shown). At a predetermined timing after the input of the signal, the photoreceptors 101 to 104, and the intermediate transfer body 501 is rotated by a driving motor (not shown).

At the same time with the photoreceptors 101 to 104, a preliminary cleaning operation is performed with the photoreceptor cleaning units 301 to 304, and then, a charge operation by the photoreceptor charge units 201 to 204, an exposure operation by an exposure unit (not shown), and a development operation by the development units 401 to 404 are performed. Each toner image formed on each of the photoreceptors 101 to 104 in this way is transferred to the intermediate transfer body 501 by forming electric fields with a polarity opposite to the toner on the primary transfer bias rollers 504 to 507 at a predetermined timing and a visible image is formed in monochrome or multicolor. On this occasion, the photoreceptor cleaning units 301 to 304 respectively cleans a toner image which is not transferred onto the intermediate transfer body 501 and which stays on the photoreceptors 101 to 104.

On the other hand, after the input of the image signal, at a predetermined timing, the recording medium P is moved out from the paper feed table 3 and is bumped into the resist roller 800 to be stopped. Then, the resist roller 800 is rotated at the timing synchronized with the visible image on the intermediate transfer body 501 to send the recording medium P between the intermediate transfer body 501 and the secondary transfer unit 600. Moreover, an electric field with the same polarity as the toner is formed on the secondary transfer bias roller 502 by a secondary transfer electric field forming unit and the visible image on the intermediate transfer body 501 is secondarily transferred onto the recording medium P. Subsequently, the recording medium P passes through the fixing unit 5 and the visible image is fixed on the transfer material by applying heat and pressure. On the other hand, the intermediate transfer body cleaning unit 520 removes a toner image which is not transferred onto the recording medium P and which stays on the intermediate transfer body 501 for preparing the next image formation.

A first portion according to the present invention will then be described.

In the present invention, the following cleaning operation (hereinafter, "adhering substance removal mode") is performed at the time other than the time of the normal image formation. First, when the adhering substance removal mode is activated for the photoreceptors 101 to 104 or the intermediate transfer body 501, the tandem image forming unit 1 forms a toner image on at least a portion of the photoreceptors 101 to 104, forms an electric field with a polarity opposite to the toner by the primary transfer bias rollers 504 to 507 and primarily transfers the toner image onto the intermediate transfer body 501, as is the case with the normal image forming operation. Contrary to the normal image formation, the toner image on the intermediate transfer body 501 is not secondarily transferred to the transfer body and is directly carried to the intermediate transfer body cleaning unit 520, and an idling rotation operation is performed for a certain time period while the toner image is scraped and removed by the blade member 521. Subsequently, the photoreceptor cleaning units 301 to 304 scrape and remove the minute residual toner on the photoreceptors 101 to 104 which is not transferred onto the intermediate transfer body 501 in the same manner. At the same time, the lubricant agents 313 and 523 are applied by the lubricant agent application brushes 312 and 522 to the photoreceptors 101 to 104 and the intermediate transfer body 501, respectively.

By putting into the photoreceptor cleaning units 301 to 304 and the intermediate transfer body cleaning unit 520 a toner image having a toner amount larger than a toner amount (a transfer-residual toner amount) put at the normal time, the substances adhering to the surfaces are intertangled and attached with the toner image and cleaned along with the toner. To achieve this effect a certain amount of toner is needed, and such an operation is performed because the transfer-residual toner amount at the normal time cannot exert sufficient force by itself.

The toner amount is adjusted by the charge operation of the photoreceptor charge units 201 to 204, the exposure operation of the exposure unit (not shown), the development operation by the development units 401 to 404 and the like. This adjustment is performed by several methods and, in one method, as is the case with the normal image forming operation, the photoreceptors 101 to 104 are charged by the photoreceptor charge units 201 to 204 and exposed by the exposure unit (not shown) and the development operation is performed by the development units 401 to 404. However, in the case of an apparatus utilizing an AC electric field for the photoreceptor charge units 201 to 204, an oxidation product may be formed undesirably on the photoreceptors 101 to 104 by ozone generated by AC. Therefore, in order not to apply AC as far as possible, in a second method, the toner image formation is performed only by the output of the development units 401 to 404 without performing the output of the photoreceptor charge units 201 to 204 and the exposure unit not shown.

Figure 5A:
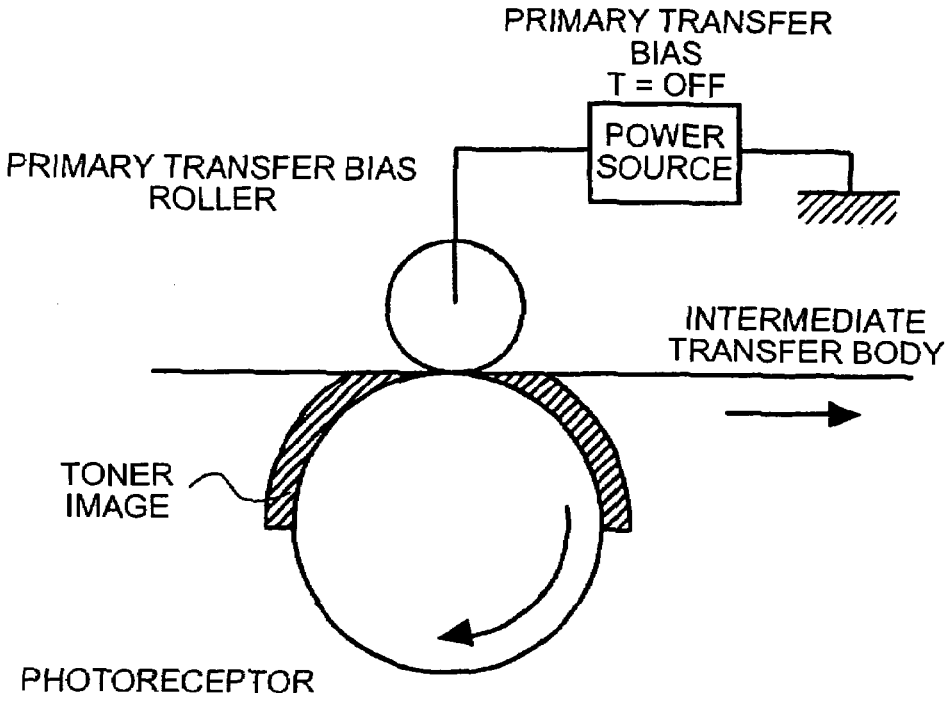
FIG. 5A is a schematic for explaining an adhering substance removal mode example (1) according to the embodiment.

As shown in FIG. 5A, when the toner image formed on the photoreceptor charge units 201 to 204 is transferred to the intermediate transfer body 501, by adjusting the intensity of the electric field applied to the primary transfer bias rollers 504 to 507, the amount of the toner can be differentiated. For example, if the adhering substance removal mode is wished to be applied only to the photoreceptors 101 to 104, a toner image is formed on the photoreceptors 101 to 104 with only an amount necessary for the photoreceptors 101 to 104, and by turning off the electric field of the primary transfer bias rollers 504 to 507, almost all of the formed toner image can be put into the photoreceptors 101 to 104.

Figure 5B:
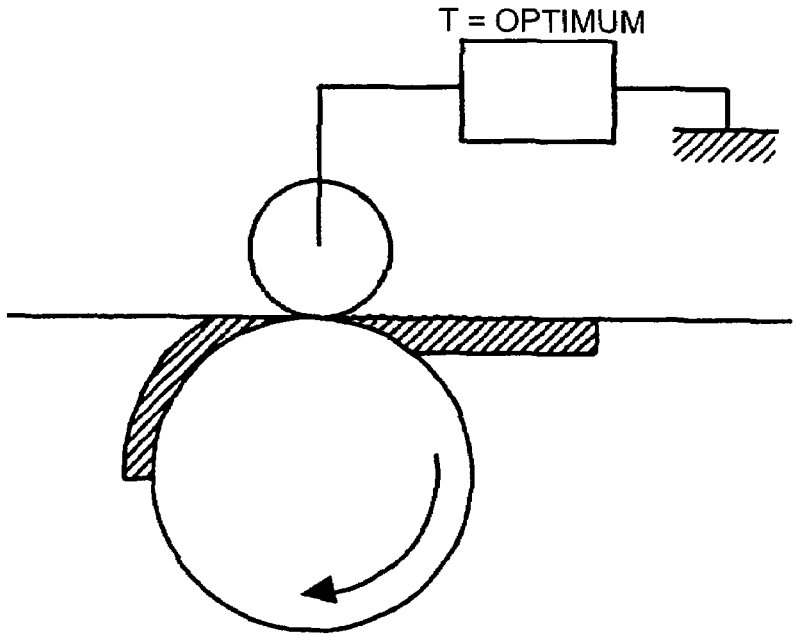
FIG. 5B is a schematic for explaining an adhering substance removal mode example (2) according to the embodiment.

As shown in FIG. 5B, contrarily, if the adhering substance removal mode is to be applied only to the intermediate transfer body, a toner image is formed on the photoreceptors 101 to 104 with only an amount necessary for removing the adhering substances of the intermediate transfer body 501, and by applying a suitable transfer electric field to the primary transfer bias rollers 504 to 507, almost all the toner image can be transferred to the intermediate transfer body 501 and can be utilized in the adhering substance removal mode.

Figure 5C:
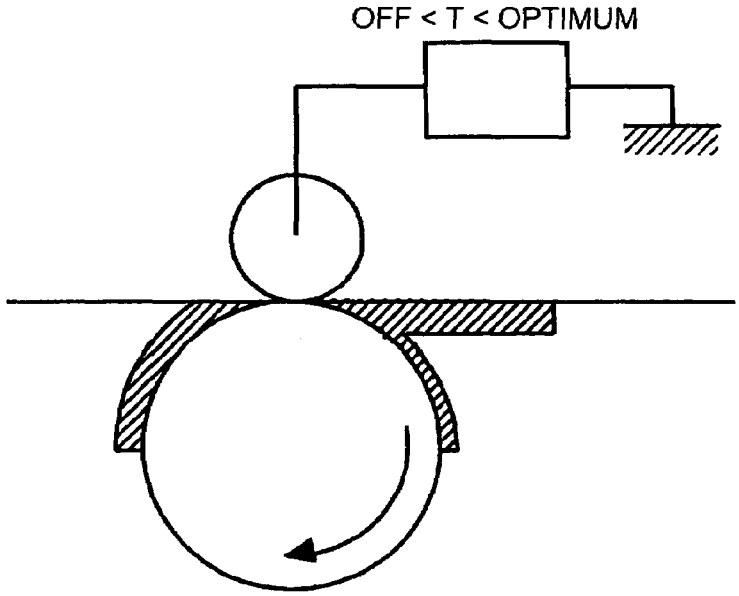
FIG. 5C is a schematic for explaining an adhering substance removal mode example (3) according to the embodiment.

Further, as shown in FIG. 5C, if both of them are wished to be in the adhering substance removal mode at the same time, the sum of the amounts necessary for both is formed on the photoreceptors 101 to 104, and by forming an electronic field weaker than the optimum transfer electric field on the primary transfer bias rollers 504 to 507, the toner can be distributed to both and the adhering substance removal mode can be applied at the same time.

In this way, if the adhering substance removal mode is performed at the same time, a time period for operating the adhering substance removal mode can be shortened to reduce the waiting time of the user of the apparatus, as compared to performing the adhering substance removal modes for the photoreceptors and the intermediate transfer body separately.

Although the adhering substance removal mode utilizing the toner image has been described as above, another effect expected from the adhering substance removal mode described above is an effect of decreasing of the adherence itself due to the application of the lubricant agent. By applying the lubricant agent to the photoreceptors 101 to 104 and the intermediate transfer body 501, the friction coefficients of both are reduced and that the surfaces become more difficult to be attached with the adhering substances.

It is not necessary to apply the lubricant agent to both the photoreceptors 101 to 104 and the intermediate transfer body 501. In other words, the lubricant agent can be applied to either the photoreceptors 101 to 104 or the intermediate transfer body 501. For example, if the lubricant agent is applied only to the photoreceptors 101 to 104, since the lubricant agent on the photoreceptors is transferred to the intermediate transfer body 501, the friction coefficient of the surface of the intermediate transfer body 501 can be reduced indirectly.

When a less frequently used color is preferentially utilized as the toner image used for the adhering substance removal mode, a degree of margin can be improved for the following problems. For the less frequently used color, since the toner is stirred while staying in the development units, it is known that the charge amount is reduced and that the image quality is affected, because additives are buried and fine powders are generated. Since the effect of the adhering substance removal mode is not affected by the reduction of the charge amount, by preferentially using the less frequently used color, another effect can be utilized at the same time which allows the toner to be used evenly to prevent the toner from staying in the development units and which allows the image quality to be prevented from degrading when the image is actually formed.

It is also available to actively utilize this effect, and if the photoreceptor of the less frequently used color of the toner is not needed to be in the adhering substance removal mode, the toner can constantly be replaced by forming a toner image when the adhering substance removal mode is activated for other colors. All the colors may be simultaneously put into the adhering substance removal mode. The best time efficiency can be obtained if the adhering substance removal mode is performed for all the colors and the intermediate transfer body 501 at the same time. When doing this, if the toner images of all the colors are formed such that the toner images overlies the intermediate transfer body 501, the time efficiency is further improved.

However, since the adhering substance removal mode consumes the toner, the control may be provided for not activating the adhering substance removal mode as far as possible for the color of the toner which is close to running out such that the control can be switched to be used. For this control, the user of the apparatus may selectively set whether priority is given to the image quality or the reduction of the toner consumption.

Organic photoreceptors (OPC) are used as the photoreceptors 101 to 104, and latent images are formed by performing optical writing with a laser beam corresponding to an image of a document for the photoreceptors evenly charged to −200 to −2000 V by charge rollers (not shown). Negative/positive development is performed using negative electric toner to form toner images on the photoreceptors 101 to 104.

As the cleaning units of the photoreceptors 101 to 104, urethane rubber is used for the blade member 311 which is the cleaning member.

As the intermediate transfer body 501, an intermediate transfer belt is used which includes thermosetting resin which has a thickness of 0.10 mm, a width of 246 mm and an inner circumference length of 796 mm, and a movement speed of the intermediate transfer belt is set to 155 mm/sec. The volume resistivity of the intermediate transfer belt formed with such a material is measured to be $10^7$ to $10^{12}$ Ocm. The volume resistivity is measured with the use of the measurement method described in JISK 6911 by applying a voltage of 100 V for 10 seconds.

The surface resistivity of the intermediate transfer body 501 is measured by a resistivity measurement device "Hiresta-IP" manufactured by Mitsubishi Petrochemical Co., Ltd. to be $10^9$ to $10^{14}$ O/square. In stead of using the resistivity measurement device, the surface resistivity can be measured by the surface resistivity measurement method described in JISK 6911. As the support rollers 503, 508 and 509, metal rollers or rubber rollers having diameters of 12 mm to 26 mm are used and roller widths are set to 236 mm in order to prevent the intermediate transfer belt 501 from winding. The support roller 510 is made to have a diameter of 12 mm and a width of 230 mm which is narrower than other support rollers. For the support roller 510, a urethane-rubber blade member 521 is provided as the cleaning member.

As a secondary transfer opposed roller not shown, a roller is used which includes urethane resin foam with a diameter of 26 mm and a width of 230 mm. When the negative electric toner is used as the toner, ranges of a current of 0 to −100 μA and a voltage of 0 to 4 kV is used as the electric field applied to the secondary transfer electric field forming units for the secondary transfer.

Table 1 shows examples of output of the photoreceptor charge units 201 to 204, output of the exposure unit not shown, output of the development units 401 to 404 and output of the primary transfer bias rollers 504 to 507 at the time of the adhering substance removal mode.

TABLE 1

| | charge output | exposure output | development output | primary transfer bias output |
|---|---|---|---|---|
| setting example (a) | on (AC: −1000 to 4000 V, DC: −200 V to −2000 V) | on | on (−50 V to −2000 V) | on (DC: +200 V to +4000 V) |
| setting example (b) | off | off | on (−50 V to −2000 V) | on (DC: +200 V to +4000 V) |

In Table 1, setting example (a) is the case of forming the toner image in the same way as the normal image formation, and setting example (b) is a setting example of the case of forming the toner image without utilizing the charge units.

In the adhering substance removal mode, the operation time and the toner amount must be set optimally. First, with regard to the timing, when the target substances are not removed and stay on the intermediate transfer body 501 for a long time, the substances are firmly fixed to the surface and cannot be removed even if the removal mode is activated after that, and therefore, the substances must be removed before being fixed firmly. However, if the adhering substance removal mode is activated excessively, the waiting time is increased and the time for performing the normal image formation is reduced. Second, with regard to the operation time, while the necessary time must be ensured for removing the adhering substances, if the time is too long, the waiting time is increased and the time for performing the normal image formation is reduced. Third, with regard to the toner amount to be used, as described above, although a toner amount eclual to or larger than a certain amount is needed for exerting an effect of removing the adhering substances, if the amount is excessive, a toner amount for forming the image cannot be ensured, and if a large amount of the toner is put into the intermediate transfer body cleaning unit 520 at one time, a cleaning defect may be generated.

Thus, the operation timing, the operation time, and the toner amount to be used must be optimized to the requisite minimum. However, it is found from experiments that the optimum values vary depending on an environment surrounding the apparatus and a method of using the apparatus. Therefore, a maximum effect can be obtained with minimum adverse effects (loss of time and toner) if the adhering substance removal mode is optimally controlled after detecting such information.

As the information to be detected for controlling the conditions of the adhering substance removal mode, the number of times of the image formation can be pointed out. As the number of times of the image formation increases, the talc from the paper powders and the component exuded from the rubber increasingly adhere, and therefore, the adhering substance removal mode may be activated for every predetermined number of sheets which does not allow the adhering substances to adhere to the intermediate transfer body 501.

It is found from experiments that the amount of the adhering substances of the intermediate transfer body is changed depending oh temperature and humidity environments surrounding the apparatus if the number of times of the image formation is the same. Specifically, the adhering substances are increased in higher-temperature and higher-humidity environments and the adhering substances are reduced in lower-temperature and lower-humidity environments. Therefore, it is more preferred that the temperature and humidity environments surrounding the apparatus are detected by a temperature and humidity sensor (not shown) to control the adhering substance removal mode.

In more detailed research, it is found that strong correlation exists especially between the absolute humidity and the adhering substance and that the amount of the adhering substance increases as the absolute humidity increases. Therefore, when the absolute humidity is high, by increasing the operation frequency of the adhering substance removal mode or by performing control for increasing the operation time or the toner amount to be used of the adhering substance removal mode, the adhering substance removal effect without excess and deficiency can be expected.

If the number of times of the image formation is the same, the amount of the adhering substance is increased or decreased by the number of pixels at the time of the normal image formation. This is because when the toner image is secondarily transferred from the intermediate transfer body 501 to the recording medium P, the removal of the adhering substance is only weakly performed by the transfer-residual toner which is not transferred and which stays on the intermediate transfer body 501 slightly. In other words, since, if the number of pixels is high, the toner amounts is increased and the transfer-residual toner is also increased as a result, if the number of pixels is high, the adhering substance has less tendency to be left on the intermediate transfer body 501. Since the maximum number of pixels is varied by the resolution per unit area of the apparatus, it is desirable to refer to an image area rate which can ignore the effect. In other words, when the image area rate is low, by increasing the operation frequency of the adhering substance removal mode or by performing control for increasing the operation time or the toner amount to be used of the adhering substance removal mode, the adhering substance removal effect without excess and deficiency can be expected.

Additionally, when the image area rate is equal to or greater than a threshold value, the adhering substance is not fixed firmly if the adhering substance removal mode is not activated. This is because the amount of the transfer-residual toner at the time of the image formation becomes sufficient for removing the adhering substance. In such a case, the adhering substance removal mode is not needed and is desirable to be turned off.

In the case of using a member such as a semiconductive roll used by abutting against the intermediate transfer body 501 as the secondary transfer unit 600, if the adhering substance removal mode is activated while the member is in an abutting state, a portion of the toner image adheres to the member, and problems may be generated because the back side of the recording medium P is contaminated when the next image is formed or because the expected adhering substance removal effect cannot be obtained since the toner amount put into the intermediate transfer body cleaning unit 520 is reduced by an amount adhering to the member. Therefore, if such a member is used, the secondary transfer unit 600 is desirable to be spaced away from the intermediate transfer body 501.

Since more specific conditions of the example are the same as the conditions described above, overlaying descriptions are omitted here.

For the adherence of foreign substances to the intermediate transfer body 501, detailed experiments were conducted under the conditions described above. Hereinafter, unless other conditions are specified, the experiment is conducted under the standard conditions which are 23° C./50% environment and an image area rate of 5%. When the adhering substances increase, a vertical streak image becomes identified on the image of the recording medium P. Therefore, a "streak image rank" is used as a value representing a state of the adherence of the foreign substances. Each rank of the streak image is in accordance with the following criteria:

Rank 5: a level when the streak image cannot be identified at all;

Rank 4: a level when a streak can be barely identified visually;

Rank 3: a level when one streak can be identified visually;

Rank 2: a level when several streaks can be identified visually; and

Rank 1: a level when streaks can be identified on the entire surface visually.

Figure 6:
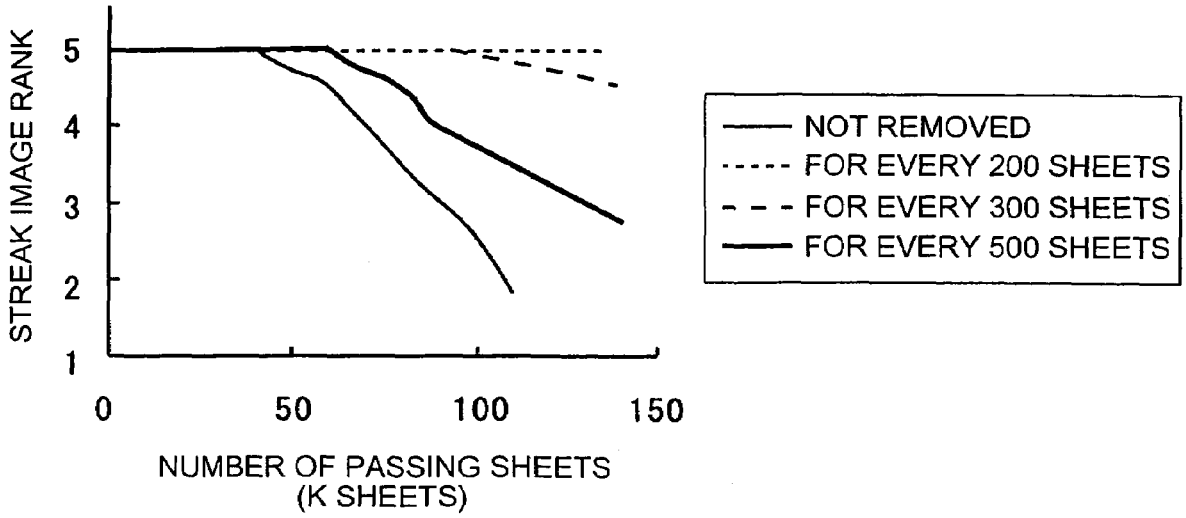
FIG. 6 is a graph of an operation frequency and a streak image rank of the adhering substance removal mode according to the embodiment.

First, under the standard conditions, running was performed while changing the number of sheets for which the adhering substance removal mode is operated. FIG. 6 shows the result. When the adhering substance removal mode was not activated, a streak image began to be seen after 50 k sheets of paper passed through, and the rank is degraded as the number of sheets increases. On the other hand, when the adhering substance removal mode was activated, improvement was recognized as compared to the case that the adhering substance removal mode was not activated, and the adhering substance removal effect was recognized. Especially, when activated at a rate of once for every 300 sheets, the streak image was not seen until the end of the experiment. In consideration of the result and the convenience of the user of the apparatus, the adhering substance removal mode is activated once for every 50 to 300 sheets.

Figure 7A:
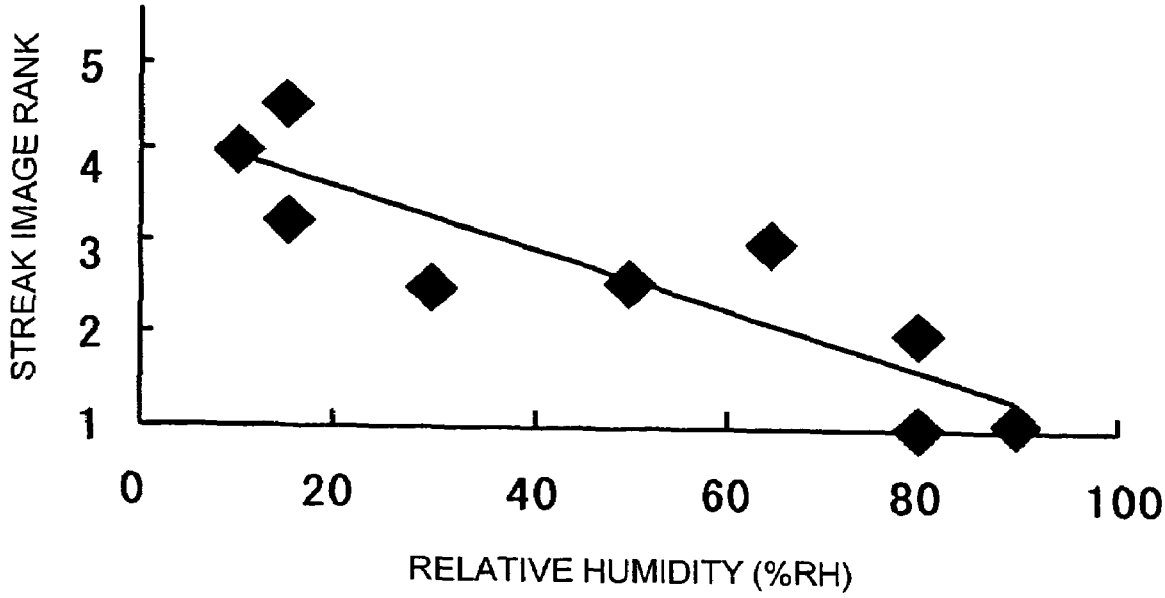
FIG. 7A is a graph of a relationship between a relative temperature and a streak image rank according to the embodiment.
Figure 7B:
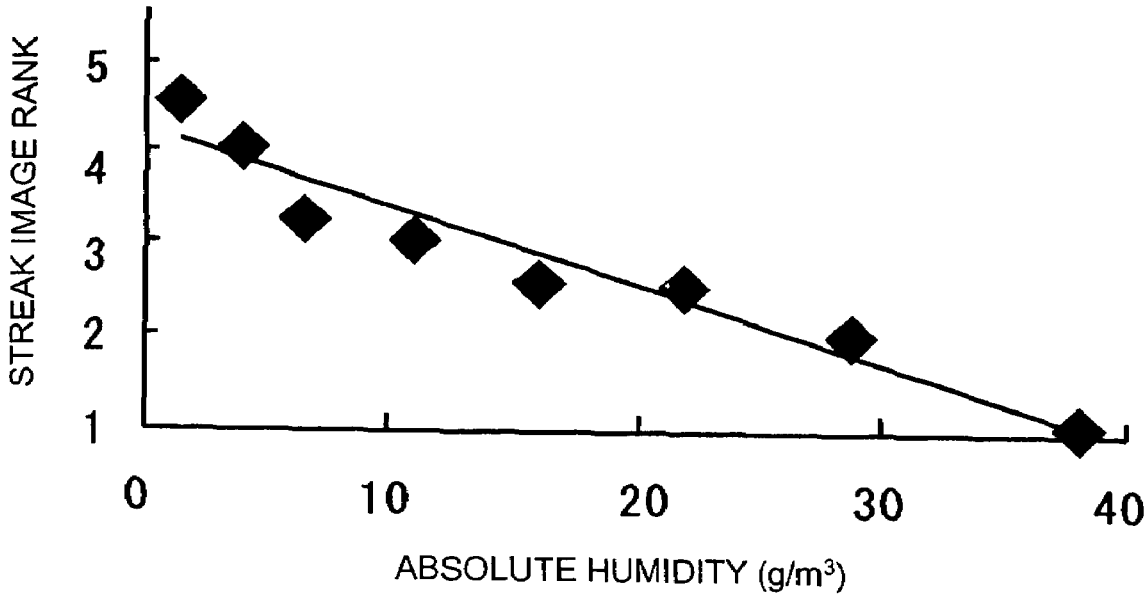
FIG. 7B is a graph for explaining a relationship between an absolute temperature and a streak image rank according to the embodiment.

Then, the relationship between the temperature and humidity environments surrounding the apparatus and the adhering substance was compared by the streak image rank after 100 k-sheets running. The adhering substance removal mode was not activated. FIG. 7A is a graphic representation showing a relationship between the relative humidity and the streak image rank. Although fluctuations exist, the higher the relative humidity is, the worse the streak image rank is. Further, FIG. 7B shows a relationship between the absolute humidity and the streak image rank, and as a result, the, absolute humidity has correlation equal to or stronger than the relative humidity. From this result, when the absolute humidity is 184.3 $g/m^3$ or more, the adhering substance removal mode is activated once for every 30 to 280 sheets, and when the absolute humidity is 4.3 $g/m^3$ or less, the adhering substance removal mode is activated once for every 100 to 500 sheets. Further, as an alternative to or in conjunction with the control in accordance with the absolute humidity, control may be performed in such a way that when the relative humidity is 90% RH or more, the adhering substance removal mode is activated once for every 30 to 280 sheets and that when the relative humidity is 15% RH or less, the adhering substance removal mode is activated once for every 100 to 500 sheets.

Figure 8:
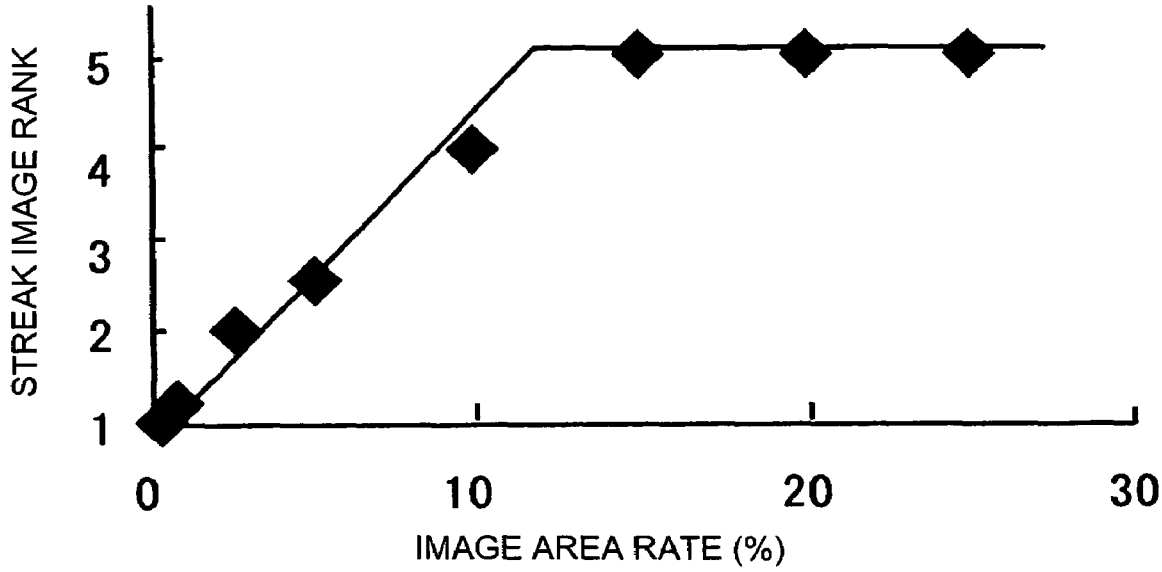
FIG. 8 is a graph for explaining a relationship between an image area rate and a streak image rank according to the embodiment.

Further, the relationship between the image area rate of the image for the running and the streak image rank was compared by the streak image rank after 100 k-sheets running. The adhering substance removal mode was not-activated. FIG. 8 shows the result. The lower the image area rate is, the worse the streak image rank is, and at 2.5% or less, the streak image rank is lower than rank 2. On the other hand, when the image area rate is 15% or more, the streak image rank is maintained at 5. From this result, if the image area rate is 2.5% or less, the adhering substance removal mode is controlled to be activated once for every 20 to 250 sheets. If the image area rate is 15% or more, the adhering substance removal mode is turned off.

While the illustrative and presently preferred embodiment of the present invention has been described in detail herein, it is to be understood that the inventive concepts may be otherwise variously embodied and employed and that the appended claims are intended to be construed to include such variations except insofar as limited by the prior art.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

an image forming unit configured to form a toner image on an image carrier;

a transferring unit configured to transfer the toner image onto a transfer body by a transfer electric field;

an image carrier cleaning unit configured to clean excess toner from the image carrier;

a transfer body cleaning unit configured to clean excess toner from the transfer body; and an electric-field controller configured to vary the transfer electric field to distribute toner onto at least one of the image carrier and the transfer body between a plurality of levels, including, a first level in which an entirety of the toner remains on the image carrier, a second level in which the entirety of the toner is distributed to the transfer body, and a third level in which less than the entirety of the toner remains on the image carrier and a remainder of the toner is distributed to the transfer body, wherein said electric field controller, at a time other than a time of image formation, is configured to adhere a larger amount of toner to at least one of the image carrier and the transfer body as compared to at the time of image formation, and at least one of the image carrier cleaning unit and the transfer body cleaning unit is configured to perform an adhering substance removal operation on at least one of the image carrier and the transfer body.

2. The image forming apparatus according to claim 1, further comprising a lubricant applying unit configured to apply a lubricant agent to at least one of the image carrier and the transfer body.

3. The image forming apparatus according to claim 1, further comprising information detection units configured to detect different pieces of information on the image formation, wherein the adhering substance removal operation is controlled in accordance with information obtained by at least one of the information detection units.

4. The image forming apparatus according to claim 3, wherein the information detection units include a unit configured to sum and store a number of times the image formation is performed, and the adhering substance removal operation is controlled in accordance with the number of times the image formation is performed.

5. The image forming apparatus according to claim 3, wherein the information detection units include a temperature and humidity sensor configured to detect a temperature and a humidity around the image formation apparatus, and the adhering substance removal operation is controlled in accordance with information on the temperature or the humidity.

6. The image forming apparatus according to claim 5, wherein information on an absolute temperature of the temperature and humidity sensor is captured when the adhering substance removal operation is controlled.

7. The image forming apparatus according to claim 3, wherein the information detection units are configured to sum and store a number of pixels of formed images, and the adhering substance removal operation is controlled in accordance with information on an image area rate, which is a rate of an area where a latent image is formed by exposure to the number of pixels or a maximum formable image size.

8. An image forming apparatus comprising:

an image forming unit configured to form a toner image on an image carrier;

a transferring unit configured to transfer the toner image onto a transfer body by means of a transfer electric field;

an image carrier cleaning unit configured to clean excess toner from the image carrier;

a transfer body cleaning unit configured to clean excess toner from the transfer body; and information detection units configured to detect different pieces of information on the image formation. wherein at a time other than a time of image formation, a larger amount of toner is adhered to any one of the image carrier and the transfer body as compared to at the time of image formation, an adhering substance removal operation is performed on any one of the image carrier and the transfer body by use of any one of the image carrier cleaning unit and the transfer body cleaning unit, the adhering substance removal operation is variably controlled in accordance with the information obtained by at least one of the information detection units, the information detection units include a unit configured to sum and memorize a number of pixels of formed images, the adhering substance removal operation is controlled in accordance with information on an image area rate, which is a rate of an area where a latent image is formed by exposure to the number of pixels or a maximum formable image size, and the adhering substance removal operation is turned off regardless of other pieces of detection information if the image area rate is equal to or greater than a threshold value.

9. The image forming apparatus according to claim 7, further comprising a member configured to abut against a surface of the transfer body, wherein the abutting member is spaced away from the transfer body before the image carrier cleaning unit or the transfer body cleaning unit perform the adhering substance removal operation.

10. The image forming apparatus according to claim 1, wherein the image forming unit is configured to form a plurality of toner images on a plurality of image carriers, and a formed toner image of each color is transferred by sequentially overlaying new images onto the transfer body.

11. The image forming apparatus according to claim 1, wherein the image forming unit is configured to form a plurality of toner images on a plurality of image carriers, and only toner of a color with a lowest toner consumption rate is used in the adhering substance removal operation.

12. An image forming apparatus, comprising:

image forming means for forming a toner image on an image carrying means;

transferring means for transferring the toner image onto a transfer body means by a transfer electric field;

image carrier cleaning means for cleaning excess toner from the image carrying means;

transfer body cleaning means for cleaning excess toner from the transfer body means; and electric-field controller means for varying the transfer electric field to distribute toner onto at least one of the image carrying means and the transfer body means between a plurality of levels, including, a first level in which an entirety of the toner remains on the image carrying means, a second level in which the entirety of the toner is distributed to the transfer body means, and a third level in which less than the entirety of the toner remains on the image carrying means and a remainder of the toner is distributed to the transfer body means, wherein said electric-field controller means, at a time other than a time of image formation, adheres a larger amount of toner, as compared to at the time of image formation, to at least one of the image carrying means and the transfer body means, and at least one of the image carrier cleaning means and the transfer body cleaning means performs an adhering substance removal operation on at least one of the image carrying means and the transfer body means.

* * * * *